US010676797B1

(12) United States Patent
Nguyen

(10) Patent No.: US 10,676,797 B1
(45) Date of Patent: Jun. 9, 2020

(54) CONCENTRATED SUGARCANE JUICE POWDER AND METHOD FOR PREPARING THE SAME USING THE CONVECTION CURRENT FREEZE DRYING APPARATUS

(71) Applicant: VINAMIT USA LLC, Tigard, OR (US)

(72) Inventor: Vien Lam Nguyen, Ho Chi Minh (VN)

(73) Assignee: VINAMIT USA LLC, Tigard, OR (US)

( * ) Notice: Subject to any disclaimer, the term of this patent is extended or adjusted under 35 U.S.C. 154(b) by 0 days.

(21) Appl. No.: 16/538,791

(22) Filed: Aug. 12, 2019

Related U.S. Application Data

(63) Continuation-in-part of application No. 16/258,639, filed on Jan. 27, 2019, and a continuation-in-part of application No. 16/371,097, filed on Mar. 31, 2019, now Pat. No. 10,451,346.

(51) Int. Cl.

| | |
|---|---|
| ***C13B 50/00*** | (2011.01) |
| ***C13B 20/00*** | (2011.01) |
| ***C13B 10/00*** | (2011.01) |
| ***C13B 10/06*** | (2011.01) |

(52) U.S. Cl.
CPC ..... *C13B 50/004* (2013.01); *C13B 10/006* (2013.01); *C13B 10/06* (2013.01); *C13B 20/002* (2013.01)

(58) Field of Classification Search
CPC .... F26B 5/04; F26B 5/06; F26B 5/044; F26B 5/042; A61J 1/14; A61J 1/1468; A61L 2/084; A61L 2/085; C13B 20/002; C13B 10/06; C13B 10/006; C13B 50/004
USPC ..... 34/92, 284, 296
See application file for complete search history.

(56) References Cited

U.S. PATENT DOCUMENTS

| | | | | |
|---|---|---|---|---|
| 3,270,434 A * | 9/1966 | Hackenberg | F26B 5/06 | 34/92 |
| 4,177,577 A * | 12/1979 | Bird | F26B 5/06 | 34/92 |
| 5,298,275 A * | 3/1994 | Balasingham | A23L 2/02 | 426/333 |
| 5,665,413 A * | 9/1997 | Rossiter | A23G 9/305 | 426/384 |
| 5,884,413 A * | 3/1999 | Anger | F26B 5/06 | 34/92 |
| 6,497,911 B1 * | 12/2002 | Hansen | A23F 3/32 | 426/285 |

(Continued)

OTHER PUBLICATIONS

"A higher brix level is worth the effort," from Healthy-Vegetable-Gardening.com, by Paul Schneider Jr. pp. 1-10, pp. 6 (Year: 2013).*

*Primary Examiner* — Stephen M Gravini

(57) ABSTRACT

A concentrated sugarcane juice powder obtained by a convection current vacuum freeze drying process that includes: selecting and preparing sugarcane stalks by a predetermined quality guideline; extracting sugarcane juice by inserting the sugarcane stalks into a sugarcane juice extracting apparatus having a mesh pattern of micro ridges configured to achieve a maximum extraction efficiency; adding probiotics into the extracted sugarcane juice; freezing the sugarcane juice mixed with the probiotics in molds using an individual quick freezer (IQF) to obtain frozen sugarcane juice blocks; and vacuum freezing said frozen sugarcane juice blocks using a convection current vacuum freeze drying apparatus.

20 Claims, 8 Drawing Sheets

FIG. 2

(56) References Cited

U.S. PATENT DOCUMENTS

| | | | | |
|---|---|---|---|---|
| 6,877,249 | B1 * | 4/2005 | Greenwood | A61K 9/19 127/46.1 |
| 6,920,701 | B2 * | 7/2005 | Haseley | F26B 5/06 34/92 |
| 8,021,706 | B2 * | 9/2011 | Bartkowska | A23G 9/04 426/565 |
| 8,685,473 | B2 * | 4/2014 | McArthur | A61K 36/22 424/777 |
| 8,793,895 | B2 * | 8/2014 | Gasteyer, III | F26B 5/06 34/287 |
| 8,793,896 | B2 * | 8/2014 | Patel | G01N 21/68 165/185 |
| 8,904,664 | B2 * | 12/2014 | Pringle | A61K 35/50 34/105 |
| 8,966,782 | B2 * | 3/2015 | Kuu | F26B 5/06 34/287 |
| 8,984,763 | B2 * | 3/2015 | Savarese | F26B 3/28 34/266 |
| 9,003,676 | B2 * | 4/2015 | Yarborough | F26B 5/06 34/287 |
| 9,121,637 | B2 * | 9/2015 | Ling | F26B 5/06 |
| 9,528,761 | B2 * | 12/2016 | Kuu | F26B 5/06 |
| 9,739,532 | B2 * | 8/2017 | Baugh | F26B 5/06 |
| 9,869,513 | B2 * | 1/2018 | Kuu | F26B 5/06 |
| 10,113,797 | B2 * | 10/2018 | Dern | F25B 13/00 |
| 10,143,716 | B2 * | 12/2018 | McArthur | A61K 36/42 |
| 10,206,409 | B2 * | 2/2019 | Peterson | A23C 9/137 |
| 10,451,346 | B1 * | 10/2019 | Nguyen | F26B 5/065 |

* cited by examiner

CONCENTRATED SUGARCANE JUICE POWDER AND METHOD FOR PREPARING THE SAME USING THE CONVECTION CURRENT FREEZE DRYING APPARATUS

CLAIM OF PRIORITY

This application is a continuation application-in-part (CIP) under 35 U.S.C. § 120 of application Ser. No. 16/258,639, entitled "Fully Automatic Convection Current Freeze Drying Method", filed on Jan. 27, 2019 which is a continuation application of application Ser. No. 16/371,097, entitled, "Convection Current Freeze Drying Apparatus and Method of Operating the Same", filed on Mar. 31, 2019. The patent applications identified above is incorporated here by reference in its entirety to provide continuity of disclosure.

FIELD OF THE INVENTION

The present invention relates generally to dried sugarcane juice and a method for preparing concentrated sugarcane juice powder. More specifically, the present invention relates to preparation of sugar cane juice powder using convection current vacuum freeze drying method.

BACKGROUND ART

Sugarcane belongs to a grass plant of the genus *saccharum*, which is easy to grow and available at cheap prices. Sugarcane juice has no fats and is loaded with abundant carbohydrates, proteins, minerals like calcium, phosphorous, iron, zinc, potassium, vitamins A, B-complex, and C, sugarcane juice is refreshing and has many health benefits including instant energy booster, ensuring safe pregnancy, preventing bad breath and tooth decay, curing Febrile disorders, aiding liver functions, acting as a digestive tonic, combating cancer, aiding people suffering from diabetes, treating sore throats, healing wounds, strengthening body organs, preventing DNA damage, aiding weight loss, eliminating toxins, treating UTI, good for nail heath, increasing muscle power, treating acidity, and boosting immunity. In addition, cold sugarcane juice is refreshing because of its delicate fragrance.

Furthermore, sugarcane is one of the important crops used to manufacture several types of sweetener such as white, refined, brown and raw sugar. However, sugarcane juice is easy to be spoiled and fermented due to microorganism contamination. If left outside of the refrigerator for 15 minutes, sugarcane juice would have adverse effects on the stomach and intestines. If prepared in unhygienic conditions, sugarcane juice may lead to diarrhea and other illnesses. Yeasts, decomposition bacteria, and pathogenic bacteria such as *salmonella* can contaminate sugarcane juice during the extraction process. Therefore, there have been many attempts to preserve sugarcane juice. Most artisan farmers use a simple crusher consisting of two or three metal roller, operated by diesel power, to compress the sugar cane and extract the juice. For preservation, the extracted juice is boiled in open pans at high temperatures between 89° C. to 92° C. until soluble solid contents near to 70 Brix. The concentration of soluble solids in the juice increases the temperature, exceeding 100° C. Just before of the syrup solidification, the temperature is ranging between 118 to 125° C., and the soluble solid content of syrup is higher than 88 Brix.

However, this well-known method of extracting, sanitizing, and preserving sugarcane juice are inefficient. First, the prior art sugarcane juice extracting mills do not have high extraction efficiency due the design of the crushing rollers. The extraction efficiency of the prior art sugarcane juice extracting mills ranged between 40% to 61% at operating speed of 0.3 m/sec. In order to obtain the maximum amount of juice from a given amount of sugarcane stalks (kg per extraction), the same stalks have to be milled repeatedly. The same sugarcane stalks have be ran through the crushing rollers many times to make sure all of the juice are extracted. This causes large chunks of pulps to fall into the juice, consumes more energy (kg/hour), lowering the output capacities and throughput. Besides, this method creates more opportunities for microorganisms to contaminate the juice. More than that, it is difficult to add other flavors such as orange juice, kumquat juice, herbs, etc. to the traditional sugarcane juice extracting mills. Second, preserving the sugarcane juice by boiling at high temperatures will cause it to lose a lot of nutrients, color, and it delicate fragrance. If fact, boiling sugarcane juice creates sugar, which is different from the original sugarcane juice. Adding acidulant and preservatives to preserve the sugarcane juice from microorganism affects the juice color and taste, causing final consumers to turn it down.

In the traditional vacuum freeze drying method (lyophilization), temperature and vacuum are controlled to achieve sublimation and desorption of water vapors from the product. In addition to avoid changes in the dried product appearance and characteristics, drying by sublimation can yield a product that has a short reconstitution time with acceptable potency levels. However, the traditional vacuum freeze drying method usually reduce chemical stability of high-water content products such as sugarcanes.

Therefore, what is needed is a method and a system that can convert extracted sugarcane juice to concentrated powder which is chemically stable, has a long shelve life, short reconstitution time with excellent potency levels—the original fragrance, nutrients, vitamins, color are preserved.

What is needed is a system that includes a sugarcane extracting apparatus that has a high extraction efficiency and high output capacity.

What is needed is a system that are fully automatic, i.e., controlled and observed by a controller unit or a computer that can create optimal freeze drying conditions for sugarcanes.

What is needed is system that can provide a high rate of cooling so that the microscopic structures of sugarcanes are preserved.

Yet, what is needed is a system that can provide specific settings including eutectic temperatures ($T_{eu}$), optimal temperatures ($T_{opt}$), pressures, and cooling rates for sugarcanes so that structural collapse can be avoided.

Finally, what is needed is a sugarcane composition powder that includes probiotics so that it is easy to digest after reconstitution by mixing with water.

The method and system disclosed in the present invention solve the above described problems.

SUMMARY OF THE INVENTION

Accordingly, an object of the present invention is to provide a concentrated sugarcane juice powder obtained by a convection current vacuum freeze drying process that includes: selecting and preparing sugarcane stalks by a predetermined quality guideline; extracting sugarcane juice by inserting the sugarcane stalks into a sugarcane juice extracting apparatus having a mesh pattern of micro ridges configured to achieve a maximum extraction efficiency;

adding probiotics into the extracted sugarcane juice; freezing the sugarcane juice mixed with the probiotics in molds using an individual quick freezer (IQF) to obtain frozen sugarcane juice blocks; and vacuum freezing said frozen sugarcane juice blocks using a convection current vacuum freeze drying apparatus.

Another object of the present invention is to provide a method for preparing a concentrated sugarcane juice powder that includes: selecting and preparing sugarcane stalks by a predetermined quality guideline; extracting sugarcane juice by inserting the sugarcane stalks into a sugarcane juice extracting apparatus having a mesh pattern of micro ridges configured to achieve a maximum extraction efficiency; adding probiotics into the extracted sugarcane juice; freezing the sugarcane juice mixed with the probiotics in molds using an individual quick freezer (IQF) to obtain frozen sugarcane juice blocks; and vacuum freezing said frozen sugarcane juice blocks using a convection current vacuum freeze drying apparatus.

Another object of the present invention is to provide a system for manufacturing concentrated sugarcane juice powder that includes: an sugarcane juice extracting apparatus having mesh pattern crushing ridges, an individual quick freezer (IQF), and a convection current vacuum freeze drying apparatus with a condenser that have a high rate of cooling using heat transfer of natural convection currents between the condenser unit and a plurality of elongate tubes having circumferential fins.

Another object of the present invention is to achieve a vacuum freeze drying apparatus and process that are fully automatic, i.e., controlled and observed by a controller unit or computer that can create optimal freeze drying conditions for sugarcane juice.

Another object of the present invention is to achieve a vacuum freeze drying apparatus and method that can provide a high rate of cooling using heat transfer of natural convection currents between the condenser unit and a plurality of elongate tubes having circumferential fins.

Furthermore, another object of the present invention is to achieve a vacuum freeze drying apparatus and process that can provide a deep and uniform freezing zone of the same temperature and pressure so that the quality of the sugarcane juice being freeze dried is uniform.

Yet, another object of the present invention is to achieve a vacuum freeze drying apparatus and process that can provide specific settings including temperatures, pressures, and cooling rates for sugarcane juice so that structural collapse can be avoided.

Another object of the present invention is to provide a concentrated sugarcane juice powder mixed with a predetermined amount of probiotics that improves digestive health, and powerful benefits for body and brain.

Finally, another object of the present invention is to achieve a computer software program stored in a non-transitory memory that can perform an optimal convection current vacuum freeze drying process for sugarcane juice when such computer software program is executed by a controller unit.

These and other advantages of the present invention will no doubt become obvious to those of ordinary skill in the art after having read the following detailed description of the preferred embodiments, which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
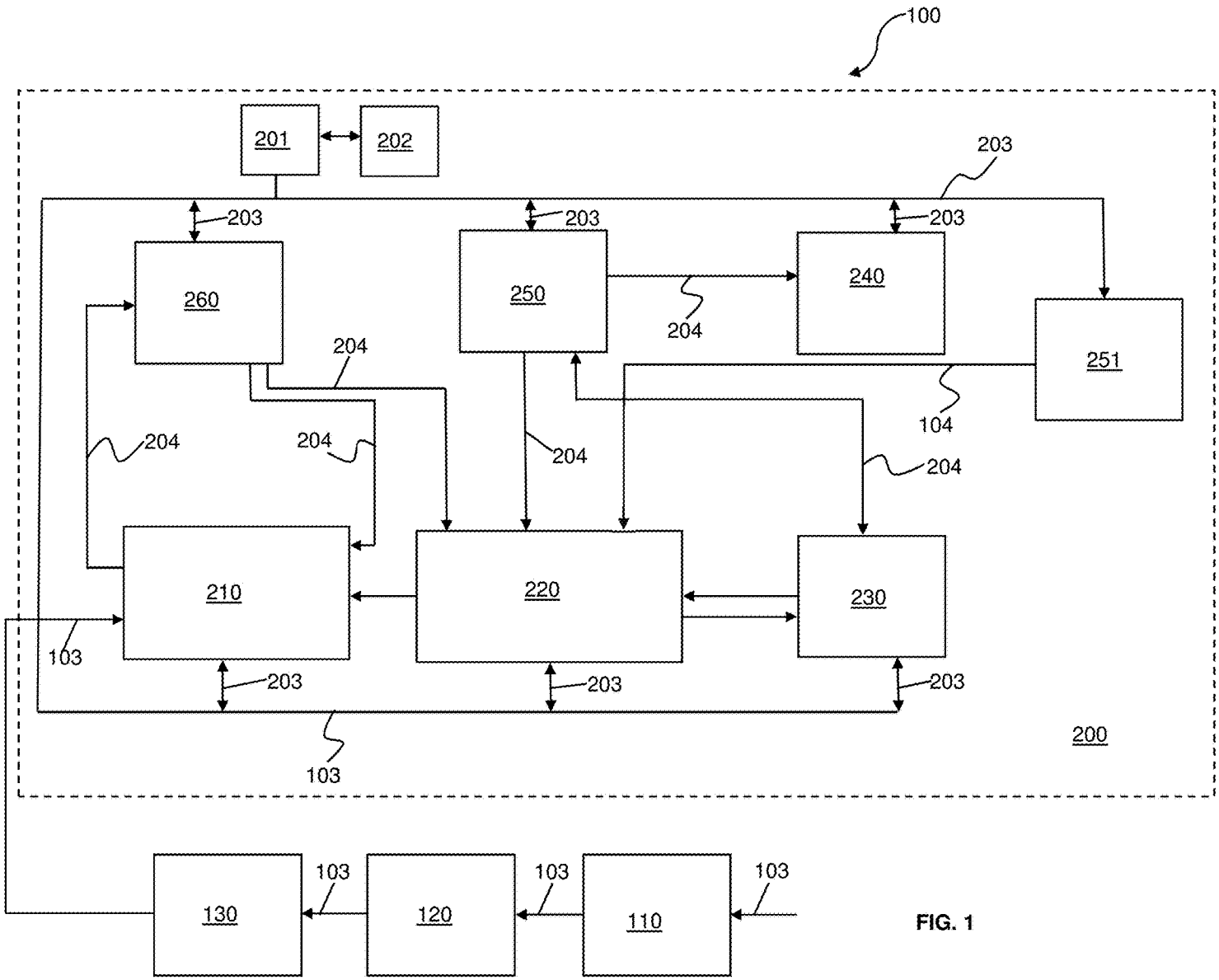
FIG. 1 is a block diagram illustrating a system for preparing concentrated sugarcane juice powder using a convection current vacuum freeze drying apparatus and a sugarcane extracting apparatus having mesh pattern micro ridges crushing rollers in accordance with an embodiment of the present invention.

One embodiment of the invention is now described with reference to FIG. 1. FIG. 1 illustrates a block diagram of a system 100 for preparing concentrated sugarcane juice powder using a convection current vacuum freeze drying apparatus and a sugarcane extracting apparatus having mesh pattern micro ridges crushing rollers in accordance with an exemplary embodiment of the present invention. System 100 includes a sugarcane stalks peeling apparatus 110, a sugarcane extracting apparatus 120, a pre-freezing individual quick freezer (IQF) 130, and a convection current vacuum freeze drying apparatus 200. In various embodiments of the present invention, convection current vacuum freeze drying apparatus 200 further includes a dryer chamber unit 210, an ice condenser unit 220, a refrigerator unit 230, a cooling tower unit 240, a vacuum pump unit 250, and a heater unit 260, all connected together by mechanical connectors 103. In various embodiments of the present invention, mechanical connectors 103 are hollow tubes of different shapes and sizes that facilitate the flowing of fluids between the units. In some embodiments of the present invention, system 100 also includes a controller unit 201 and a database 202. Database 202 is configured to contain specific vacuum freeze drying settings for sugarcanes which have specific vacuum freeze drying settings including triple point temperatures, eutectic temperatures ($T_{eu}$), drying times, freezing rate, pressure, etc. which are studied beforehand and stored in database 202. When sugarcanes are selected to be vacuum freeze dried, specific vacuum freeze drying settings stored in database 202 will be loaded into controller unit 201. Afterwards, controller unit 201 uses the specific vacuum freeze drying settings to operate system 100 in accordance to a specific process designed for sugarcanes. It is noted that different species of sugarcanes (i.e., *Saccharum Officinarum*) not mentioned above and their specific vacuum freeze dried settings are also within the scope of the present invention. Yet, in many embodiments of the present invention, mechanical connectors 103 also connect sensing devices such as temperature sensors, pressure sensors, flow meters, timing devices, switches, and valves that can communicate with and be controlled by controller unit 201. The detailed description of these sensing devices and an exemplary embodiment of system 100 will be disclosed in FIG. 2.

Continuing with FIG. 1, the main feature of the present invention lies in sugarcane juice extracting apparatus 120, convection current ice condenser unit 220, controller unit 201, database 202, and the specific operating process for sugarcanes. In various embodiments of the present invention, sugarcane juice extracting apparatus 120 includes crushing rollers that have mesh patterns of micro ridges designed to provide maximum extraction efficiency of 98%.

In many embodiments of the present invention, convection current ice condenser unit 220 includes a plurality of first elongate heat exchange tubes with fins arranged around the outer circumference of the first elongate heat exchange tubes so that natural convection currents optimize the heat exchange between cold airs from refrigerator unit 230, ice condenser unit 220, and dryer unit 210. As a result, the following objects of the present invention are achieved:

The maximum extraction efficiency is achieved, saving energy, improving overall efficiency, and avoiding unwanted large chunks of pulps from falling into the juice.

A uniformly distributed and constant cold air is created throughout the entire ice condenser unit 220 and dryer unit 210;

The freezing rate can be exactly controlled;

Sugarcanes are vacuum freeze dried homogeneously without undesired quality variations due to location difference as in conventional vacuum freeze drying systems; and Furthermore, since specific vacuum freeze drying settings for sugarcanes can be learned beforehand and stored in database 202, controller unit 201 can execute the vacuum freeze drying process for sugarcanes in a precise manner and settings. As such, additional objects of the present invention are achieved:

The essence of sugarcane juice is captured at the moment sugarcanes are at their best quality. Sugarcane juice quality and essence are changed with time as they are exposed to air. If the vacuum freeze drying is either too slow or too fast, the essence of the vacuum freeze dried sugarcane juice is lost. Equipped with the exact vacuum freeze drying rate, time, and settings and stored them in database 202, controller unit 201 can execute the process to capture sugarcane juice at their best qualities.

Figure 2:
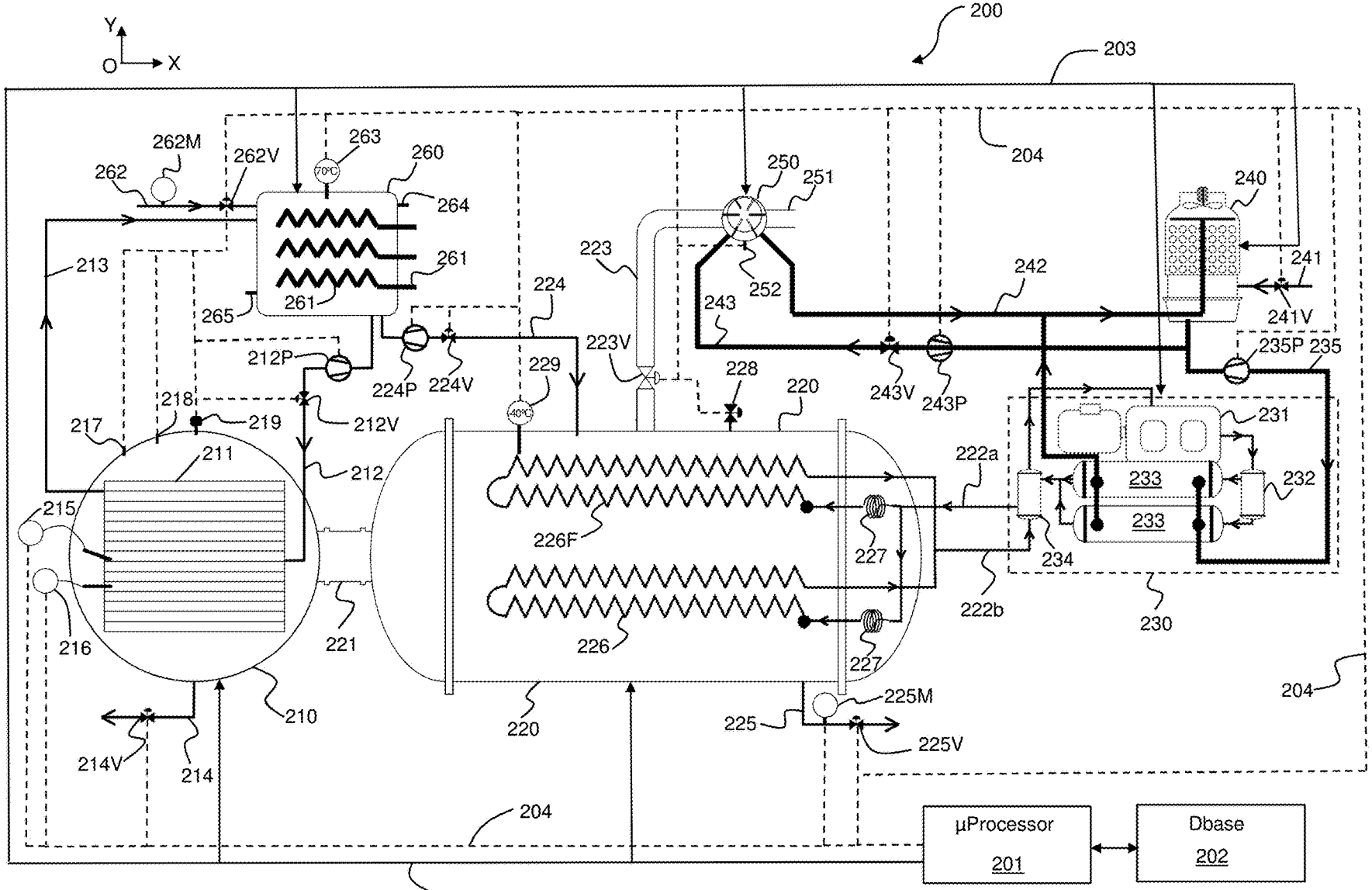
FIG. 2 is a schematic diagram of a convection current vacuum freeze drying apparatus used to dry blocks of frozen sugarcane juice mixed with probiotics in accordance with an exemplary embodiment of the present invention.

Now referring to FIG. 2, a schematic diagram of a (natural) convection current vacuum freeze drying apparatus ("CCVFD apparatus") 200 in accordance with an exemplary embodiment of the present invention is illustrated. Convection current vacuum freeze drying apparatus 200 ("CCVFD apparatus 200") includes dryer unit 210, a convection current condensing unit (ice condenser unit) 220, a refrigerator unit 230, a cooling tower unit 240, a vacuum pump unit 250, and a heater unit 260. In various embodiments of the present invention, apparatus 200 is not a stand-alone device. It is a network-based device that is connected to a controller unit 201 and a database 202 in a network (not shown). The network can be a wide area network (WAN), a local area network (LAN)], a wireless sensor network (WSN), or a cloud-based network. Furthermore, ice condenser unit 220 includes a plurality of first elongate tubes with fins that accelerate the heat exchange by natural convection currents between the cold temperatures inside ice condenser unit 220 and refrigerator unit 230, providing fast cooling rate and uniformly distributed cold air.

Continuing with FIG. 2, controller unit 201 and database 202 are connected to CCVFD apparatus 200 by communication channels 203. Sensors described below are connected to controller unit 201 by communication channels 204. Communication channels 204 are wireless communication channels such as W-fi, Bluetooth, RF, optical, Zigbee, etc. In some embodiments, communication channels 204 maybe data transmission cables such as RS-232, RS-422, or RS-485, etc.

Controller unit 201 serves as the brain of convection current vacuum freeze drying apparatus 200. In some exemplary embodiments, controller unit 201 is a −16 or −32 bit Programmable Logic Controller (PLC), a Supervisory Control and Data Acquisition (SCADA), or any other type of programmable logic array (PLA) consisting of a memory chip and integrated circuits for control logic, monitoring, and communicating. Controller unit 201 directs the programmable logic controller (PLC) and/or to execute control instructions, communicate with other units, carry out logic and arithmetic operations, and perform internal diagnostics. Controller unit 201 runs memory routines, constantly checking the PLC to avoid programming errors and ensure the memory is undamaged. Memory provides permanent storage to the operating system for database 202 used by controller unit 201. Five programming languages are used in controller unit 201 and PLC. They are defined by the international standard IEC 61131. Ladder logic is one of the most commonly used PLC languages. Another programming language is function block diagram (FBD). It describes functions between input and output variables. The function, represented by blocks, connects input and output variables. FBD is useful in depicting algorithms and logic from interconnected controls systems. Structured Text (ST) is a high-level language that uses sentence commands. In ST, programmers can use "if/then/else," "SQRT," or "repeat/ until" statements to create programs. Instruction list (IL) is a low-level language with functions and variables defined by a simple list. Program control is done by jump instructions and sub-routines with optional parameters. Sequential Function Chart (SFC) language is a method of programming complex control systems. It uses basic building blocks that run their own sub-routines. Program files are written in other programming languages. SFC divides large and complicated programming tasks into smaller and more manageable tasks.

Dryer unit 210 includes trays 211, a hot water pipe 212, a freeze dried chamber-heater hot water valve 212V ("hot water valve 212V"), a freeze dried chamber-heater hot water pump 212P ("hot water pump 212P"), a return water pipe 213, a discharge water pipe 214, a discharge water valve 214V, a first tray temperature transmitter 215, a second tray temperature transmitter 216, a front door switch 217, a rear door switch 218, a vacuum pressure transmitter 219, all connected as shown in FIG. 2. Hot water valve 212V, hot water pump 212P, discharge water valve 214V, first tray temperature transmitter 215, second tray temperature transmitter 216, front door switch 217, rear door switch 218, vacuum pressure transmitter 219 are network devices that can communicate with controller unit 201.

Continuing with FIG. 2, convection current condensing unit (ice condenser unit) 220 connects to dryer unit 210 by a large ice condenser and freeze dried chamber connection pipe 221. Ice condenser unit 220 is connected to refrigerator unit 230 via a liquid refrigerant pipe 222*a*, a gaseous refrigerant pipe 222*b*, expansion capillary tubes 227; to vacuum pump unit 250 via a vacuum pipe 223, a vacuum isolating valve 223V; to heater unit 260 via an ice condenser heater hot water pipe 224, an ice condenser heater hot water valve 224V, an ice condenser heater hot water pump 224P, an ice condenser discharge valve 225, an ice condenser discharge flow meter 225M, and an ice condenser discharge valve 225V. Ice condenser unit 220 further includes convection current heat exchanging tubes with fins 226F, convection current heat exchanging tubes without fins 226, a vacuum release valve 228, and an ice condenser temperature transmitter 229. In many embodiments, vacuum isolating valve 223V, ice condenser heater hot water valve 224V, ice condenser heater hot water pump 224P, ice condenser discharge valve 225, ice condenser discharge flow meter 225M, and ice condenser discharge valve 225V, vacuum release valve 228, and ice condenser temperature transmitter 229 are network devices controlled by controller unit 201.

Still referring to FIG. 2, refrigerator unit 230 includes a compressor 231, a refrigerant container 232, a liquid refrigerant heat exchanger 233, a refrigerant heat exchanger 234, a cooling water pipe 235, a cooling water pump 235P. Cooling water pump 235B is network device that can be controlled by controller unit 201.

Still referring to FIG. 2, cooling tower unit 240 includes a feed water pipe 241, a feed water valve 241V, a hot water returning pipe 242, a cooling water pipe for vacuum pump unit 243, a cooling water pump for vacuum pump unit 243P, a cooling water valve for vacuum pump unit 243V. Feed water valve 241V, cooling water pipe for vacuum pump unit 243, cooling water pump 243P, a cooling water valve 243V are network devices which can be controlled and communicated to controller unit 201. Vacuum pump unit 250 includes a vacuum input pipe 251 and a current transformer transmitter which is network device. Water heater unit (heater) 260, a three-phase heating element 261, a feed water pipe 262, a feed water flow meter 262M, a feed water valve 262V, a heater temperature transmitter 263, a high water level sensor 264, and a low water level sensor 265 which are also network devices. In some embodiment of the present invention, a Hanbell vacuum type PS1302-AC1 with pumping speed of 15700 L/m, power source of 389V at 50 Hz, and ultimate pressure of 0.00075 torr is used.

In operation, apparatus 200 is fully controlled by controller unit 201 as described in details in process 800 below. In other words, in various embodiments of the present invention, process 800 including operational steps 801 to 820 are implemented by apparatuses 100 and 200. The detailed description of apparatus 200 is described in application Ser. No. 16/258,639, entitled "Fully Automatic Convection Current Freeze Drying Method", filed on Jan. 27, 2019 which is a continuation application of application Ser. No. 16/371,097, entitled, "Convection Current Freeze Drying Apparatus and Method of Operating the Same", filed on Mar. 31, 2019. These patent applications identified above is incorporated here by reference in its entirety to provide continuity of disclosure.

Figure 3:
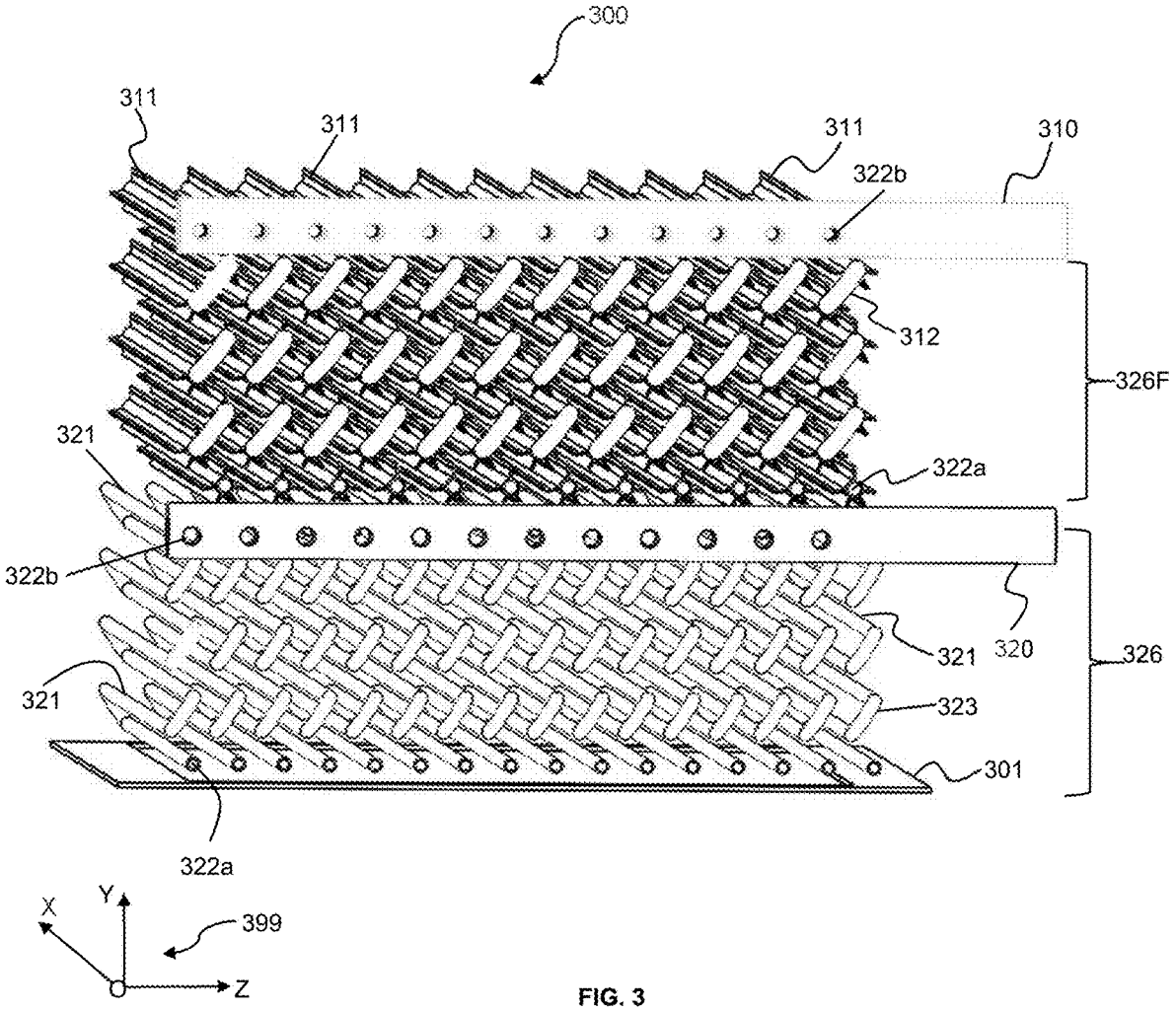
FIG. 3 is a three-dimensional perspective diagram of the internal structure of the ice condenser unit of the convection current vacuum freeze drying apparatus used to dry blocks of frozen sugarcane juice mixed with probiotics in accordance with an exemplary embodiment of the present invention.

Now referring to FIG. 3, a three-dimensional diagram of the internal structure 300 of the convection current ice condenser unit 220 in accordance with an exemplary embodiment of the present invention is illustrated. Internal structure 300 includes a rectangular base 301 spanning along a horizontal z-direction of an xyz coordinate 399. An array of first elongate heat exchange tubes with fins 326F and an array of second elongate heat exchange tubes without fins 326 are stacked on top of each other and rectangular base 301. Specifically, array of first elongate heat exchange tubes with fins 326F is a three-dimensional M×N array, where M is the number of first elongate heat exchange tubes with fins 311 along the z-direction and N is the number of first elongate heat exchange tubes with fins 311 along the vertical Y direction. Each first elongate heat exchange tubes with fins 311 has a length L spanning along the X direction. In one exemplary embodiment, M is 12, N is 8, and L is 30 mm. In other words, the number of first elongate heat exchange tubes with fins 311 in a row along the Z direction is 12. The number first elongate heat exchange tubes with fins 311 in a column along the Y direction is 8. The length of first elongate heat exchange tubes with fins 311 is 30 mm. Together, the number of first elongate heat exchange tubes with fins 311 in rows Z and in columns Y and their length L form three-dimensional array 326F.

Continuing with FIG. 3, array of second elongate heat exchange tubes without fins 326 is a three-dimensional M×N array, where M is the number of second elongate heat exchange tubes without fins 321 along the z-direction and N is the number of second elongate heat exchange tubes without fins 321 along the vertical Y direction. Each second elongate heat exchange tubes without fins 321 has a length L spanning along the X direction. In one exemplary embodiment, M is 16, N is 8, and L is 30 mm. In other words, the number of second elongate heat exchange tubes without fins 321 in a row along the Z direction is 16. The number of second elongate heat exchange tubes without fins 321 in a column along the Y direction is 8. The length of second elongate heat exchange tubes without fins 321 is 30 mm. Together, the number of second elongate heat exchange tubes without fins 321 in rows Z and in columns Y and their length L form three-dimensional array 326.

Figure 4:
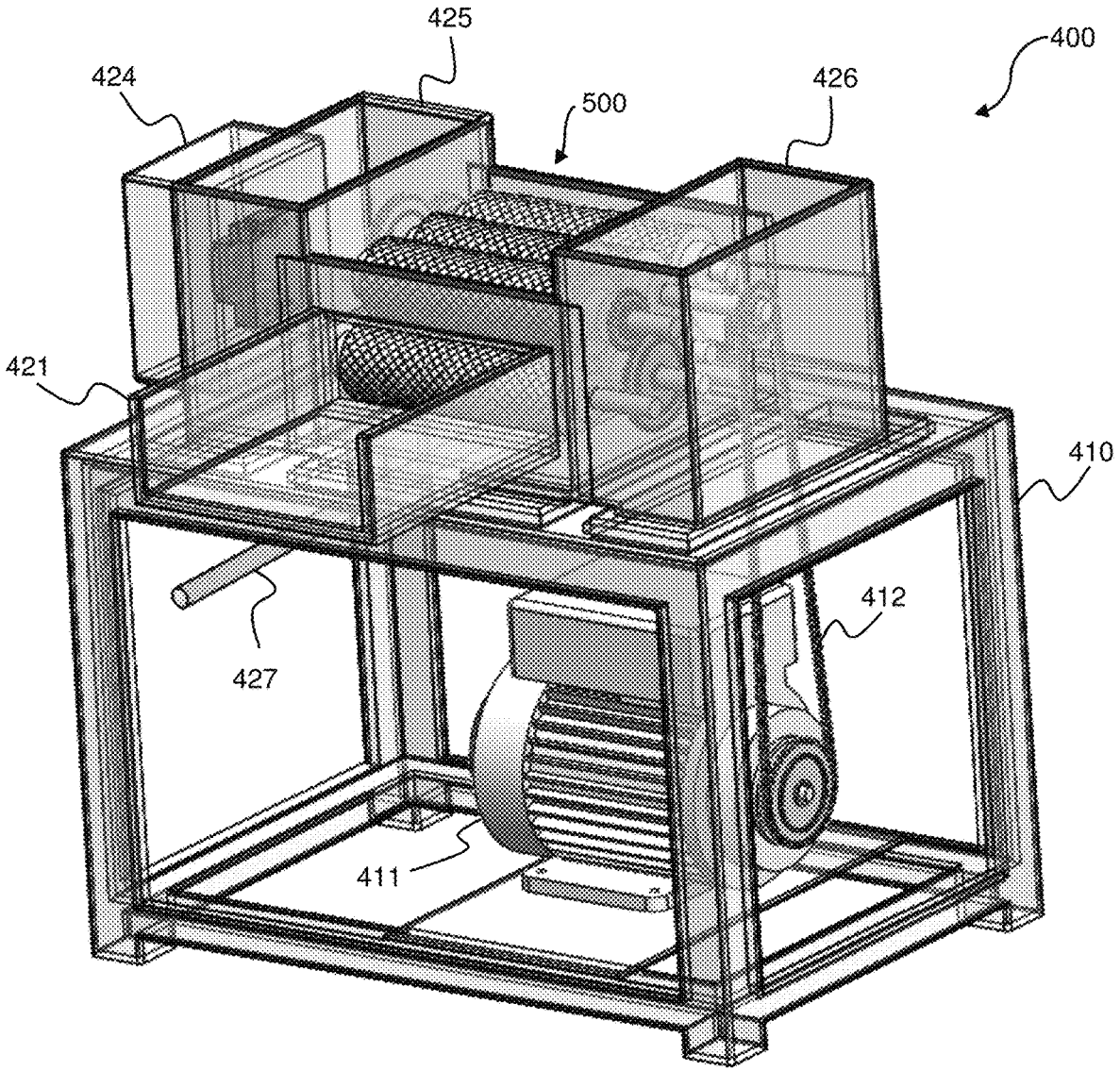
FIG. 4 is a three-dimensional (3D) perspective diagram of a sugarcane juice extracting apparatus in accordance with an exemplary embodiment of the present invention.

Now referring to FIG. 4, a three-dimensional (3D) perspective diagram of a sugarcane juice extracting apparatus 400 is illustrated in accordance with an exemplary embodiment of the present invention. Sugarcane juice extracting apparatus 400 includes a base 410 that contains a motor 411 and a chain 412. Mounted on the top surface of base 410 are a plurality of crushing rollers 500, an input terminal 421, and output terminal 423 where sugarcane stalks residues are collected, an electrical compartment 424 designed to switch on/off sugarcane juice extracting apparatus 400, and a mechanical compartment 426 that houses the mechanical connections between motor 411 and plurality of crushing rollers 500 via chain 412. A basin (not shown) is arranged beneath plurality of crushing rollers 500 designed to collect the extracted juice. An output siphon 427 connected to container designed to draw the extracted juice out of the basin. In many embodiments of the present invention, the capacity of sugarcane juice extracting apparatus 400 is at 500 kg/hour.

Figure 5A:
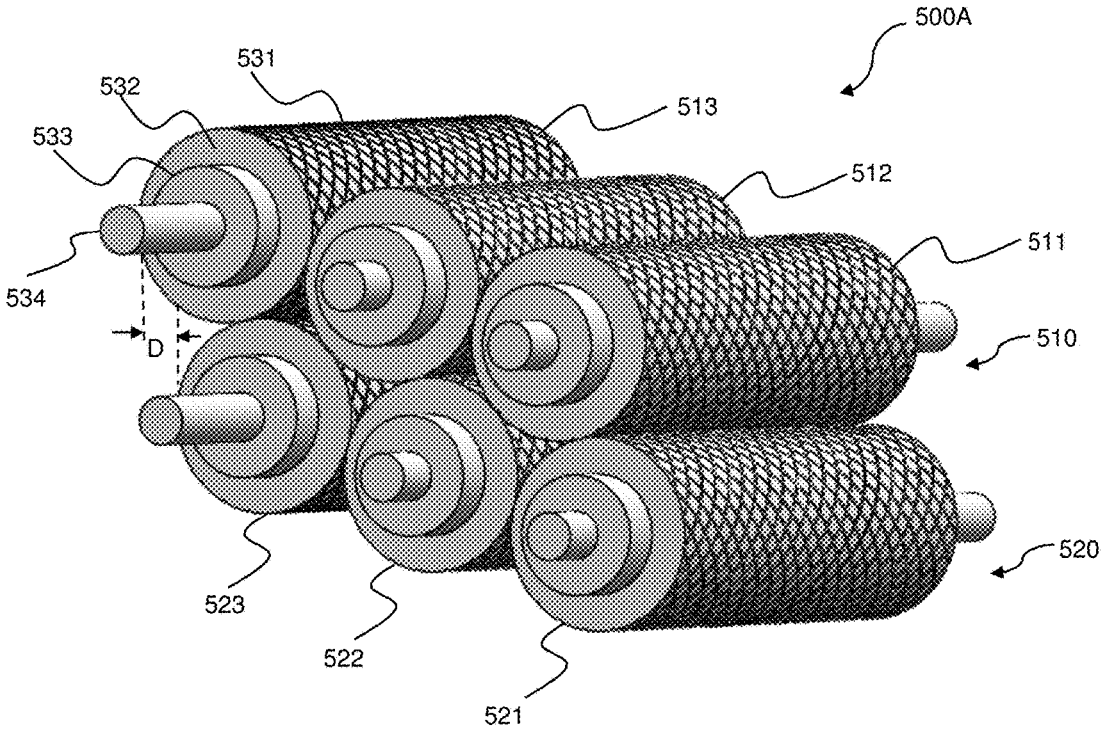
FIG. 5A is a three-dimensional (3D) perspective diagram illustrating a stagger formation of a top row of crushing sugarcane rollers and bottom row of crushing sugarcane rollers in accordance with an exemplary embodiment of the present invention.

Next referring to FIG. 5A, a three-dimensional arrangement of plurality of crushing rollers 500A is illustrated. In most preferred embodiment, plurality of crushing rollers 500 includes a top row 510 of crushing rollers 511, 512, and 513 arranged in tandem to one another. Specifically, top row 510 includes a front crushing roller 511, a middle crushing rollers 512, and a rear crushing roller 513 arranged in tandem to one another. In other words, front crushing roller 511, middle crushing roller 512, and rear crushing roller 513 are arranged one after another in a straight line. Similarly, a bottom row 520 includes crushing rollers 521, 522, and 523 which are also arranged in tandem to one another. Specifically, bottom row 520 includes a front crushing roller 521, a middle crushing rollers 522, and a rear crushing roller 523 arranged in tandem to one another. In other words, Front crushing roller 521, middle crushing roller 522, and rear crushing roller 523 are arranged one after another in a straight line. Furthermore, top row 510 of crushing rollers 511-513 are arranged in stagger formation with bottom row 520 of crushing rollers 521-523. Front crushing roller 511 in top row 510 is arranged at an offset distance D behind front crushing roller 521 in bottom row 520. That is, front crushing roller 511 is located between front crushing rollers 521 and middle crushing roller 522 in bottom row 520. Middle crushing roller 512 in front row 510 is located between middle crushing roller 522 and rear crushing roller 523 in bottom row 520. In present invention, the offset distance D of the stagger formation is between 3 cm-7 cm.

Referring again to FIG. 5A, in various embodiments of the present invention, all crushing rollers 511-523 have the same structure. Each crushing roller 511-523 includes an outer cylindrical 532 and an inner cylindrical 533, and a main shaft 534. Outer cylindrical has an outer surface 531 and a longitudinal length of 500 mm and a diameter of 80 mm. Inner cylindrical 533 has a length of 580 mm and a diameter of 50 mm. Main shaft 534 has a diameter of 20 mm. All crushing roller 511-523 are made of stainless steel.

Figure 5B:
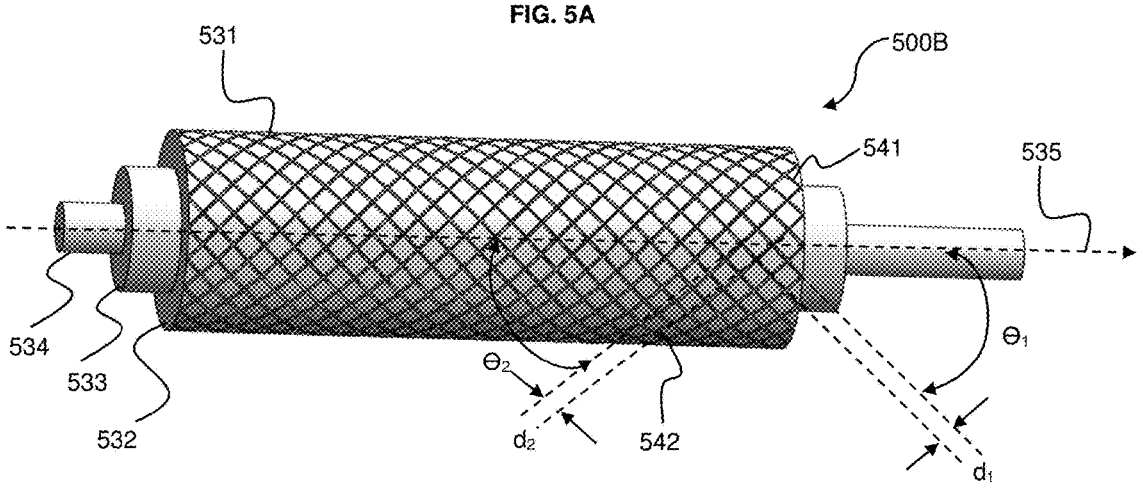
FIG. 5B is a three-dimensional (3D) perspective diagram illustrating a mesh structure of micro ridges of a single crushing roller in accordance with an exemplary embodiment of the present invention.

Next referring to FIG. 5B, a three-dimensional (3D) perspective diagram of a mesh structure of micro ridges 500B of a single sugarcane crushing roller is illustrated. As alluded above, each crushing rollers 511-523 includes outer surface 531 imprinted with mesh pattern structure of micro ridges 500B ("micro ridges 500B"). Micro ridges 500B includes a first plurality of ridges 541 running from left to right of crushing roller 511-523 at an angle $\Theta_1$ about 450 with respect to a common axis 535. First plurality of ridges 541 are parallel to one another at a distance $d_1$ of 1.5 mm. Micro ridges 500B also includes a second plurality of ridges 541 running from right to left of crushing roller 511-523 at an angle $\Theta_2$ about 45° with respect to a common axis 535. Second plurality of ridges 542 are parallel to one another at a distance $d_2$ of 1.5 mm. First plurality of ridges 541 and second plurality of ridges 542 cross one another to form mesh pattern of micro ridges 500B. Each micro ridge 500B has a depth of 1.4 mm. As a result of micro ridges 500B, the following objects of the present invention are achieved: The maximum extraction efficiency of 98% is achieved, saving energy, improving overall efficiency, and avoiding unwanted large chunks of pulps from falling into the juice.

Figure 6:
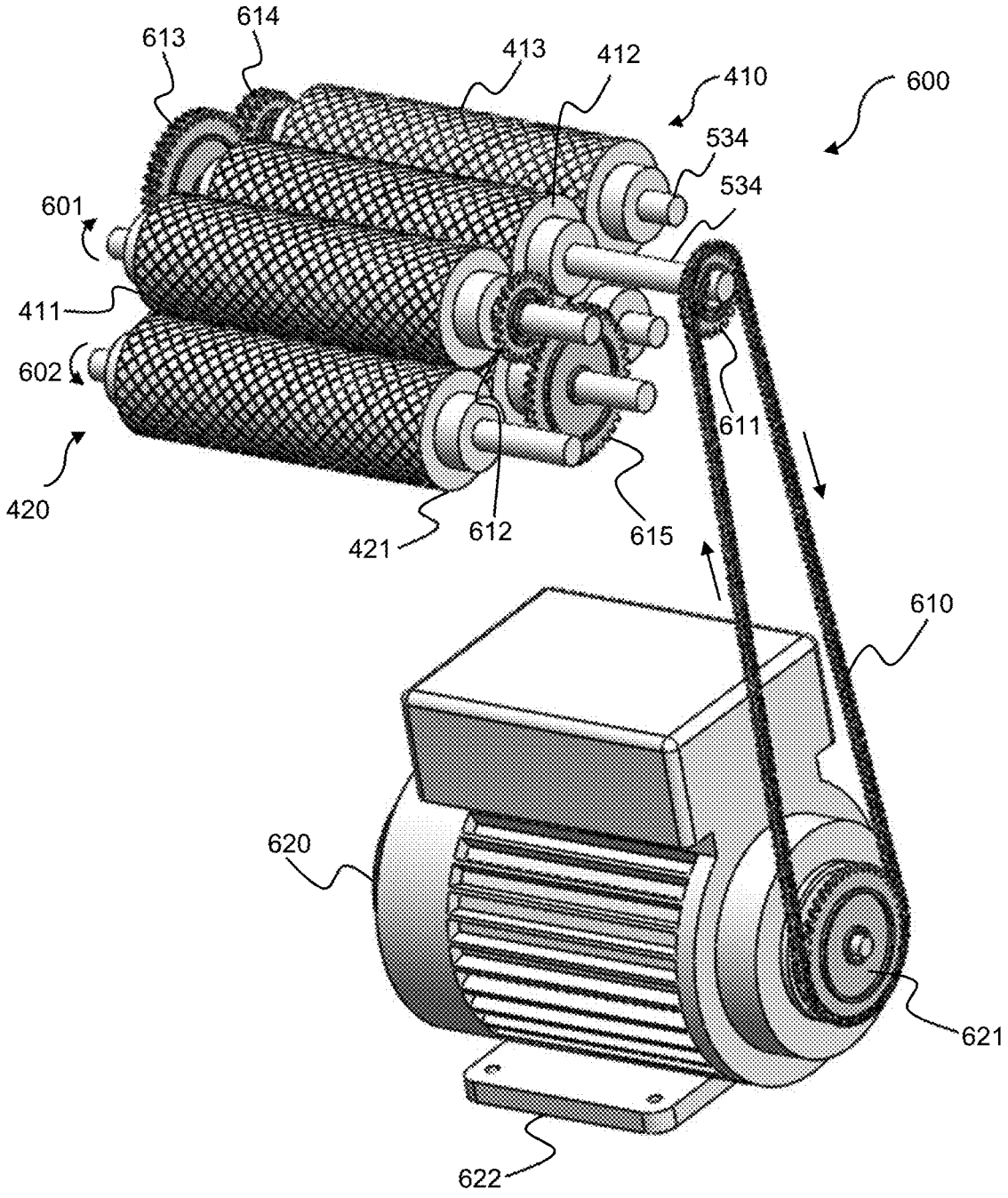
FIG. 6 is a three-dimensional (3D) perspective diagram illustrating the main operating components of the sugarcane juice extracting apparatus that includes a motor and the crushing rollers in stagger formation in accordance with an exemplary embodiment of the present invention.

Now referring to FIG. 6, FIG. 6 illustrates the main operating components of the sugarcane juice extracting apparatus that includes a motor and the crushing rollers in stagger formation in accordance with an exemplary embodiment of the present invention. Main shaft 534 of middle crushing roller 412 has the longest length and is mechanically secured to a driving gear 611. The opposite side of middle crushing roller a third pinion gear 613 is connected to main shaft 534. A second pinion gear 612 is connected to main shaft 534 of front crushing roller 411. On the other side, a fourth pinion gear 614 is connected to main shaft 534 of rear crushing roller 413. On bottom row 420, a fifth pinion gear 615 is connected to main shaft 534 of middle crushing roller 422. A motor 620 has a driving gear 621 that is connected to drive driving gear 611 using a chain 610. Motor 620 has a base 622 that is securely bolted to base 410. In operation, when motor 620 is started, it causes all crushing rollers 411-413 to rotate in a first direction 601 because third pinion gear 613 is engaged to fourth pinion gear 614. As crushing rollers 411-413 rotate, they cause bottom row 420 of crushing rollers 421-423 to rotate in the opposite direction 602. As a result, crushing rollers 411-423 operate together to draw sugarcanes stalks in and crushing them. Mesh formation of micro ridges crush the sugarcane stalks and extract the maximum amount of juice out. In addition, since the direction of drawing of crushing rollers 411-423 is substantially linear, the sugarcane stalks are not bent and broken, the maximum amount of juice is extracted.

Figure 7:
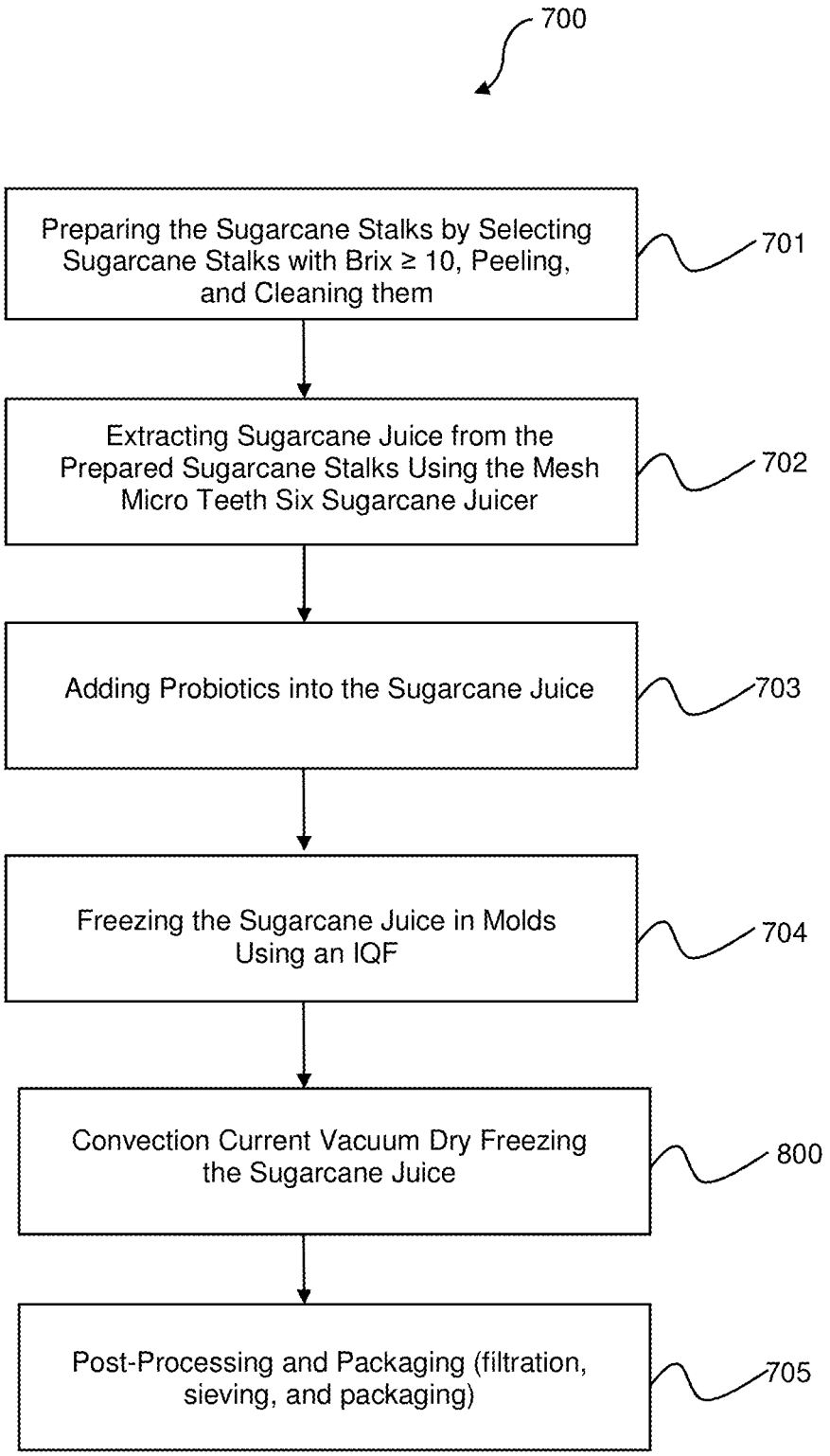
FIG. 7 is a flow chart illustrating a process of preparing concentrated sugarcane juice powder using a convection current vacuum freeze drying apparatus in accordance with an exemplary embodiment of the present invention.

Now referring to FIG. 7, a flow chart of a process of preparing concentrated sugarcane juice powder 700 using a convection current vacuum freeze drying apparatus 200 and sugarcane juice extracting apparatus 400 is illustrated in accordance with an exemplary embodiment of the present invention. First, sugarcane stalks are prepared, their juice are extracted, probiotics are added to increase digestive and other health benefits, the mixture of sugarcane juice and probiotics are frozen in blocks, then they are vacuum freeze drying by a convection current vacuum freeze apparatus, and finally the vacuum freeze dried sugarcane juice powder is obtained and post-processed such as filtering and packaging.

At step 701, sugarcanes are selected using a predetermined quality guideline. The predetermined quality guideline includes selecting only sugarcanes that are healthy, heaving, without any spoilage darkened spots, solid cores without any sign of hollowness. Most importantly, sugarcane stalks selected must have a Brix level of at least 10°. The selected sugarcane stalks are peeled, removing the rinds, cleaned thoroughly.

At step 702, the selected and cleaned sugarcane stalks are extracted using a sugarcane juice extracting apparatus. In many aspects of the present invention, step 702 is implemented by sugarcane juice extracting apparatus 400 as described above in FIG. 4-FIG. 6. Using the mesh pattern of micro ridges of sugarcane juice extracting apparatus 400, the extraction efficiency of the present invention is at 98%. The capacity of sugarcane juice extracting apparatus 400 is again at 500 kg/hour.

After the juice are obtained, at step 703, probiotics are added. In the implementation of step 703, probiotics *lactobasillus, streptocucus*, and *bifidobacterium* are added at an amount of 0.75 g to 1 g of *lactobasillus, streptocucus*, and *bifidobacterium* per every 100 g of sugarcane juice.

Next, at step 704, the mixture of sugarcane juice and probiotics are pre-freezing in blocks using molds. Step 704 can be implemented using pre-freezing individual quick freezer (IQF) 130. Sugarcane juice and probiotics are poured into rectangular molds and pre-frozen at to −40° C. to −35° C. for 25 minutes to 30 minutes.

At step 800, the blocks of frozen sugarcane juice are vacuum freeze dried using a convection current vacuum freeze drying apparatus as described in the application Ser. No. 16/258,639, entitled "Fully Automatic Convection Current Freeze Drying Method", filed on Jan. 27, 2019 which is a continuation application of application Ser. No. 16/371,097, entitled, "Convection Current Freeze Drying Apparatus and Method of Operating the Same", filed on Mar. 31, 2019. These patent applications are incorporated here by reference in its entirety to provide continuity of disclosure. Step 800 is described in detailed below in FIG. 8.

Finally, at step 705, the concentrated sugarcane juice powder is post-processed. In various aspects of the present invention, step 705 is implemented by filtration, sieving, and packaging.

Figure 8:
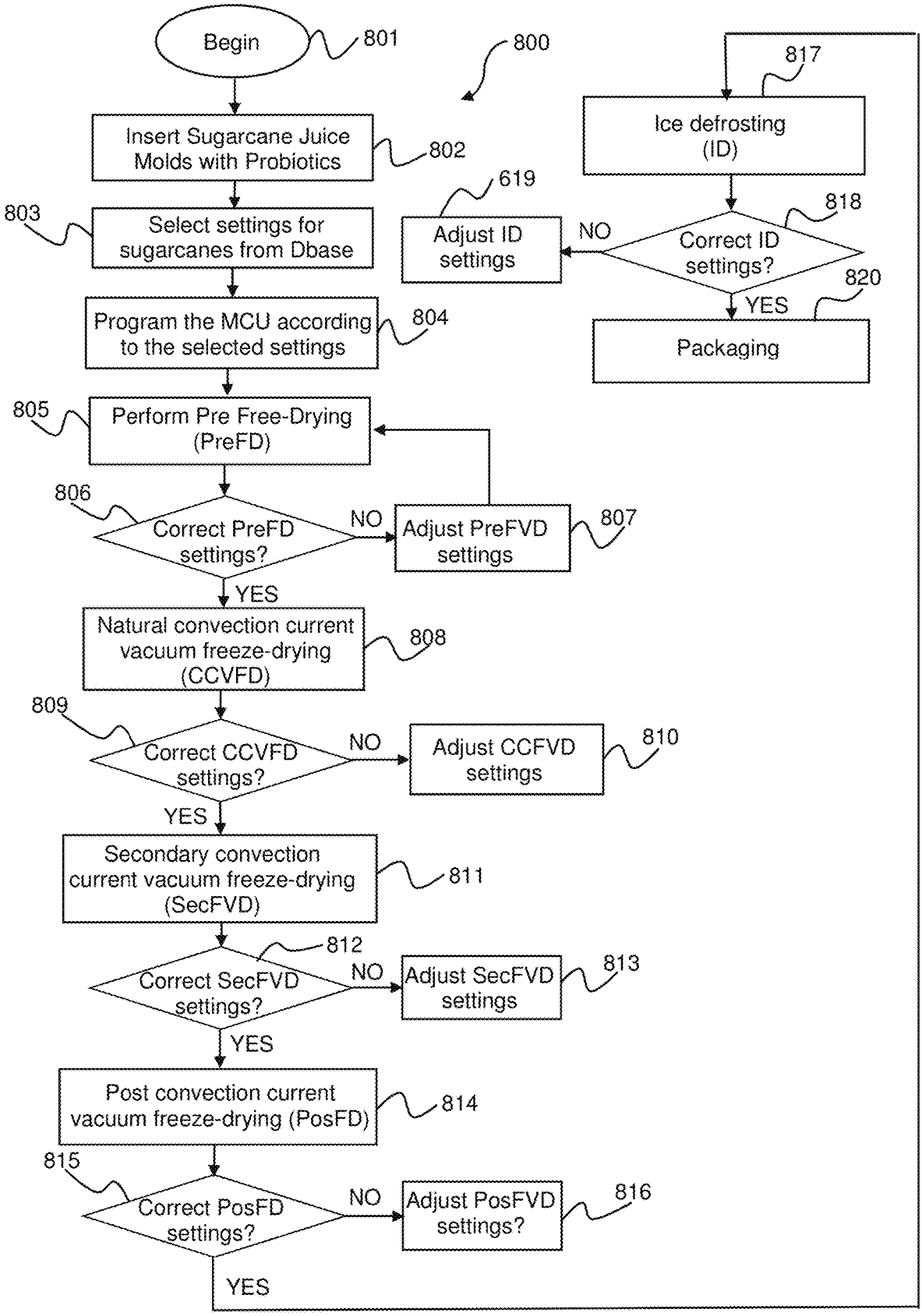
FIG. 8 is a flow chart illustrating a process of operating a convection current vacuum freeze drying apparatus for preparing concentrated sugarcane juice powder in accordance with an exemplary embodiment of the present invention.

Next referring to FIG. 8, a flow chart illustrating a method 800 of operating convection current vacuum freeze drying apparatus 200 ("apparatus 200") in accordance with an exemplary embodiment of the present invention is illustrated. The operation of apparatus 200 illustrated by process 800 further includes the following operational steps: performing the preliminary convection current vacuum free drying (pre CCVFD) 801-804, performing the primary convection current vacuum free drying (pri CCVFD) 805-808, performing secondary convection current vacuum free drying (sec CCVFD) 809-812, performing post convection current vacuum free drying (post CCVFD) 813-816, and performing ice defrosting 817-820.

In the pri CCFVD operational steps 801-804, the refrigerator unit 230 is started to collect cold air inside and dryer unit 210 and ice condenser unit 220. Discharge water valve 214V and ice condenser discharge valve 225V are closed. Cooling water pump for vacuum pump unit 243P and cooling water valve 243V are switched off. The water circulation in dryer unit 210 is closed off. At the same time, freeze dried chamber-heater hot water valve 212V is switched on. Fans in cooling tower unit 240 is turned on. Cooling water pump 235P is also turned on to cool compressors 231. After compressor 231 are turned on, the temperatures of a plurality of elongate heat exchange tubes with radially arranged fins 226 are recorded via temperature transmitter (also known as thermometer or thermal coupler) 229. Controller unit 201 observes whether the temperature is lowered by 5° C. If it does not, alarm signals are sent out. Controller unit 201 sends diagnostic signals to inspect refrigerator unit 230. If refrigerator unit 230 is normal, trays 211 are loaded with blocks of frozen sugarcane juice. In some embodiments of the present invention, conveyors (not shown) will thrust trays 311 loaded with the selected sugarcane juice deep inside dryer unit 210.

At step 801, method 800 begins by cleaning and checking all the electrical as well as mechanical connections between the component units are correct and secured as described in FIG. 2 above. All valves, e.g., 212V, 214V, 223V, 225V, 228, 243V, 263V, are released to clear all residual water out of the system and ice defrosting step is performed. In other words, step 801 involves all necessary preparatory steps prior to the vacuum freeze drying process begins. In many aspects of the present invention, step 801 may involve calibration procedure to ensure proper and accurate performance of apparatus 200 in accordance with ISO standards such as ISO 13408. The preparatory steps may include temperature tests such as shelves temperatures tests with and without loads, steam in place (SIP) test to ensure proper sterilization of apparatus 200, and tests for vacuum pump unit 250, etc.

At step 802, sugarcanes in blocks of frozen sugarcane juice prepared by process 700 above to be vacuum freeze dried is selected. The juices of sugarcanes are first substantially extracted using sugarcane extracting apparatus 400 as described in FIG. 4 to FIG. 6 above. The frozen blocks made from molds of sugarcane juice are laid in trays 211. Controller unit 201 and database 202 are informed and programmed to perform the next steps accordingly.

Next, at step 803, specific settings for sugarcanes in step 801 are located from a preconfigured database. The preconfigured database is a database built from careful and thorough prior clinical tests for sugarcane juice. Clinical tests are performed to obtain specific settings include eutectic temperatures ($T_{eu}$), critical temperatures ($T_C$), triple point or sublimation temperatures ($T_{SUB}$), optimal temperatures ($T_{opt}$), pressures, durations for each phase (t sec), etc. for sugarcane juice. In many aspects of the present invention, step 803 is implemented by database 202. The specific settings for sugarcane juice are stored in database 202 such as Look-Up Table (LUT); Read and Write memory; CD-ROM; DVD; HD-DVD; Blue-Ray Discs; etc.; semiconductor memory such as RAM, EPROM, EEPROM, etc.; and/or magnetic memory such as hard-disk drive, floppy-disk drive, tape drive, MRAM, etc. A simple exemplary database in accordance with an exemplary embodiment of the present invention is listed in Table 1 below. Please note that Table 1 is only a simplified example of the database of the present invention. In reality, the database can have other settings listed above which are necessary to carry out an optimal convection current freeze drying process for sugarcanes.

TABLE 1

A Simplified Example of a Vacuum Freeze Drying Database

| Address | Products | Triple Point Temperatures | Pressures |
|---|---|---|---|
| 1 | Pineapple Juice | <−20° C. | <0.5 Torr. |
| 2 | Cantella Juice | <−20° C. | <0.5 Torr. |
| 3 | Durian Juice | <−18° C. | <0.5 Torr. |
| 4 | Custard Apple Juice | <−30° C. | <0.1 Torr. |
| 5 | Yogurt and Mixed Fruits | <−30° C. | <0.1 Torr. |
| 6 | Sugarcane Juice | <−20° C. | <0.2 Torr. |
| 7 | Passion Fruit Juice | <−20° C. | <0.5 Torr. |
| 8 | Ambarella Juice | <−20° C. | <0.2 Torr. |
| 9 | Coconut Milk Juice | <−20° C. | <0.5 Torr. |
| 10 | Ready to Drink Coffee | <−20° C. | <0.5 Torr. |
| 11 | Amaranth Juice | <−20° C. | <0.5 Torr. |
| 12 | Kumquat Juice | <−20° C. | <0.5 Torr. |
| 13 | Minced Banana chunks | <−20° C. | <0.5 Torr. |
| 14 | Minced Jack Fruit Chunks | <−20° C. | <0.5 Torr. |
| 15 | Minced Mango Chunks | <−20° C. | <0.5 Torr. |
| 16 | Minced Pineapple Chunks | <−20° C. | <0.5 Torr. |

TABLE 1-continued

A Simplified Example of a Vacuum Freeze Drying Database

| Address | Products | Triple Point Temperatures | Pressures |
|---|---|---|---|
| 17 | Minced Durian Chunks | <−20° C. | <0.5 Torr. |
| 18 | Minced Dragon Fruit Chunks | <−20° C. | <0.5 Torr. |

Next, at step 804, after all the settings are located in the database, a controller unit is programmed with the above settings. In many exemplary embodiments of the present invention, step 804 is implemented by controller unit 201 which includes, but not limited to, a desktop computer, a laptop computer, a Programmable Logic Controller (PLC), a Supervisory Control and Data Acquisition (SCADA), or any other type of microprocessors or programmable logic array (PLA).

More specifically, in the pri CCFVD operational steps 805-807, the refrigerator unit 230 is started to collect cold air inside and dryer unit 210 and ice condenser unit 220. Discharge water valve 214V and ice condenser discharge valve 225V are closed. Cooling water pump for vacuum pump unit 243P and cooling water valve 243V are switched off. The water circulation in dryer unit 210 is closed off. At the same time, freeze dried chamber-heater hot water valve 212V is switched on. Fans in cooling tower unit 240 is turned on. Cooling water pump 235P is also turned on to cool compressors 231. After compressor 231 are turned on, the temperatures of a plurality of elongate heat exchange tubes with radially arranged fins 226F are recorded via temperature transmitter (also known as thermometer or IoT thermometer) 229. Controller unit 201 observes whether the temperature is lowered by 5° C. If it does not, alarm signals are sent out. Controller unit 201 sends diagnostic signals to inspect refrigerator unit 230. If refrigerator unit 230 is normal, trays 211 are loaded with sugarcanes listed in Table 1. In some embodiments of the present invention, conveyors (not shown) will thrust trays 211 loaded with the selected sugarcane juice deep inside dryer unit 210.

Continuing with operational steps pre CCVFD 805-807 and FIG. 2, tray temperature transmitters 215 and 216 are moved into position to record tray temperatures during the convection current vacuum freeze drying process. The door(s) of dryer unit 210 are automatically closed by turning on front door switch 217 and rear door switch 218. Sensors will alarm controller unit 201 if doors are not hermetically closed. Cooling water valve 243V and cooling water pump 243P are switched on to cool vacuum pump unit 250. Vacuum isolating valve 223V is tightly switched off so that when vacuum pump unit 250 is turned on it will not be overloaded. Controller unit 201 observes when vacuum pump unit 250 is overloaded. If vacuum pump is overloaded, controller unit 201 tightens up vacuum isolating valve 223V and checks for overloading again. Some time-outs can be provided to apparatus 200 during correction steps. This correction repeats until vacuum pump unit 250 is not overloaded. When this condition happens, controller unit 201 turns on vacuum pump unit 223V by 5% per minute until vacuum pump unit 250 is fully throttled on. At this time, the pre CCVFD operational steps 805-807 end.

At step 805, a preliminary convection current vacuum free drying step (pre CCVFD) is performed. In the implementation of step 805, all the valves and flow meters are turned off so that all main units 210 to 260 are isolated from one another. First, heater unit 260 and the vacuum pump unit 250 are turned off because it is not required in the early stages of the process. Meanwhile, ice condenser unit 220, refrigerator unit 230, and cooling tower unit 240 are turned on. Ice condenser unit 220 is slowly set to a temperature less than the initiation temperature of 5° C. Once this initiation temperature is achieved for a first predetermined time duration, sugarcanes listed in Table 1 is loaded either manually or by an automatic conveyor which is controlled by controller unit 201. When all trays 211 in dryer unit 210 are finished loading, vacuum pump unit 250 is turned on. Cooling tower valve 243V and vacuum pump isolating valve 223V are turned off. Next, a second predetermined time duration is set by controller unit 201. Finally, vacuum pump unit 250 is checked for overloading. If vacuum pump unit 250 is overloaded, controller unit 201 will reset the second predetermined time duration until the overloading condition is cleared. Then, vacuum pump isolating valve 223V connecting vacuum pump unit 250 and ice condenser unit 220 is slowly opened at a predetermined rate of approximately 5% per minute until this vacuum pump isolation valve 223V is fully opened. Thus, the objective of the pre CCVFD operational step is to set up the initial temperature (less than 5° C.) and slowly turning on vacuum pump unit 220 at a predetermined rate of 5% per minute.

At step 806, the initiation temperature, the first predetermined time duration, the second predetermined time duration, the rate, and other settings of the preliminary convection current vacuum free drying are sensed by sensors and sent to a controller unit. The controller unit compares these observed setting data with those stored in the database and determines whether the preliminary CCVFD is performed correctly. In many embodiments of the present invention, step 806 can be implemented by controller unit 201, database 202, and sensors such as, 215, 216, 219, 225M, 229, 252, 262M, 263, 264, etc. which can be observed remotely by devices such as cell phones, laptops, computers, etc. that are connected to the network. In a preferred embodiment, convection current vacuum freeze drying apparatus 200 of the present invention is network-based. In some embodiments, convection current vacuum freeze drying apparatus 200 of the present invention is a stand-alone machine which is not connected to any network.

At step 807, the settings of the preliminary CCVFD is sensed by the sensors. Similar to step 806, the sublimation temperature (Tsus), the third predetermine time duration, the state of the valves are constantly observed. In many embodiments of the present invention, all sensors are network-based devices. Step 807 can be implemented by, controller unit 201, database 202, sensors such as, 215, 216, 219, 225M, 229, 252, 262M, 263, 264, etc. that are connected to a network such as the industrial wireless sensor network (IWSN).

Next at step 808, a primary convection current vacuum free drying (pri CCVFD) operational step is performed. In the primary convection current vacuum drying operational step, the controller unit brings the ice condenser unit well below the triple point (sublimation) temperature of sugarcanes for a third predetermined time duration. Please see Table 1. As an example, when sugarcanes are selected, the sublimation temperature ($T_{SUB}$) is maintained at −20° C. for 11 hours. A vacuum pipe 223V connecting the ice condenser unit 220 and the vacuum pump unit 250 is turned off so that the cold vapors from the ice condenser unit 220 are prevented from entering the vacuum pump unit 250. It will be noted that the eutectic temperatures ($T_{eu}$) of sugarcane juice are taken into consideration by the controller unit to avoid eutectic melt down of sugarcane juice. Step 808 can be implemented by controller unit 201, database 202, vacuum freeze dried chamber 210, ice condenser unit 220, refrigerator unit 230 of apparatus 200 described above in FIG. 2.

In the implementations of steps 805-808, the temperatures on convection current heat exchange tubes with fins 226F are lowered and maintained at −20° C. The pressure inside ice condenser unit 220 is lowered to less than 5 Torricelli (torr.). This temperature and pressure are checked at a predetermined time duration of 10 minutes interval. Current intensities of current transformer transmitter 252 are reported. Tray temperatures from tray temperature transmitters 215 and 216 are also observed.

If the process proceeds normally, at −20° C. and 5 Torr., the water in frozen sugarcane juice blocks in trays 311 will be frozen solid for about an hour. Then, valve 212V is turned on to circulate hot water to pipes (not shown) underneath trays 211 in order to bring the tray temperature to 5° C. for 11 hours. This time duration is specific to sugarcanes. See Table 1. Controller unit 201 searches database 202 to select the correct this time duration for sugarcane juice. During this time duration, all frozen water will be transformed directly to gaseous phase without becoming liquid first.

At step 809, the settings of the primary CCVFD is sensed by the sensors. Similar to step 808, the sublimation temperature, the third predetermine time duration, the state of the valves are constantly observed. In many embodiments of the present invention, step 809 can be implemented by controller unit 201, database 202, and sensors such as, 215, 216, 219, 225M, 229, 252, 262M, 263, 264, etc.

At step 810, if any of the settings is not correct, the controller unit or any devices that are connected to the network can alarm and adjust the settings so that the optimal primary CCVFD results can be achieved. In many embodiments of the present invention, step 810 can be implemented by controller unit 201, database 202, and sensors such as, 215, 216, 219, 225M, 229, 252, 262M, 263, 264, etc.

At step 811, after correct the settings of the primary CCVFD, the controller unit goes to the secondary convection current vacuum freeze-drying (sec CCVFD) step. A time-out may be imposed on the system until all incorrect settings are adjusted. In many embodiments of the present invention, step 811 can be implemented by controller unit 201.

At step 812, secondary convection current vacuum freeze drying (sec CCVFD) step is performed. In this step, the pressure is lowered to the triple point (sublimation) and a fourth time duration is set. In the case of sugarcane juice is being freeze dried this fourth time period is 10 minutes. Then the tray temperatures are increased by 5° C. step by a fifth time duration of about 30 minutes. Finally, tray temperatures are held at 5° C. for a sixth predetermine time duration of about 8 hours so that all remaining frozen solutes in sugarcane juice change directly into vapor phases without becoming liquid. In step 812, heater unit is turned on and the all the valves are connecting the dryer unit and the heater unit are opened. Step 812 can be implemented by controller unit 201, database 202, vacuum freeze dried chamber 210, ice condenser unit 220, refrigerator unit 230, cooling tower unit 240, vacuum pump unit 250, and heater unit 260 of apparatus 200 described above in FIG. 2.

At step 813, the settings of the secondary CCVFD is sensed by the sensors. Similar to step 812, the sublimation temperatures (Tsue), pressures, tray temperatures, and the predetermine time durations are constantly observed. In many embodiments of the present invention, step 813 can be implemented by controller unit 201, database 202, and sensors such as, 215, 216, 219, 225M, 229, 252, 262M, 263, 264, etc.

To summarize steps 810-813, operation step (sec CCVFD) is very similar to the pri CCVFD steps 804-809 except that the temperatures inside dryer unit 210 are increased to about 65° C. by turning on the circulation of hot water from heater unit 260. Trays 211 are heated up by the vapors from sugarcane juice during the convection current vacuum freeze drying process. The sec CCVFD step aims is to vaporize the remaining water from the sugarcane juice.

Now referring to step 814, a post convection current vacuum freeze drying (post CCVFD) operational step is performed. In this step, the refrigerator unit, the vacuum pump unit, the cooling tower unit are turned off in that specific order for a seventh predetermined time duration prior to the release of the vacuum unit valve to avoid damaging the dried sugarcane juice. In many aspects of the present invention, step 814 can be implemented by controller unit 201, database 202, vacuum freeze dried chamber 210, ice condenser unit 220, refrigerator unit 230, cooling tower unit 240, vacuum pump unit 250, and heater unit 260 of apparatus 200 described above in FIG. 2.

At step 815, the settings of the post CCVFD is sensed by the sensors. Similar to step 812, the temperatures, flow meters, pressures, and the predetermine time durations are constantly observed. In many embodiments of the present invention, step 815 can be implemented by controller unit 201, database 202, and sensors such as, 215, 216, 219, 225M, 229, 252, 262M, 263, 264, etc.

At step 816, if any of the settings is not correct, the controller unit or any devices that are connected to the network can alarm and adjust the settings so that the optimal post CCVFD results can be achieved. After correct the settings of the post CCVFD, the controller unit continues step 814. A time-out may be imposed on the system until all incorrect settings are adjusted. In many embodiments of the present invention, step 816 can be implemented by controller unit 201, database 202, and sensors such as, 215, 216, 219, 225M, 229, 252, 262M, 263, 264, etc.

Post convection current vacuum freeze drying (post CCVFD) steps 814-816 are performed in apparatus 200. First, vacuum isolating valve 223V is turned off to prevent oils of vacuum pump unit 250 from entering ice condenser unit 220. Compressors 231 and cooling water pump 235P are switched off. Then freeze dried chamber-heater hot water valve 212V and freeze dried chamber heater hot water pump 212P are turned off. Cooling water pump 243P is turned off. At this moment, heater unit 260 ceases to provide heat energy to dryer unit 210. Thirty seconds (30 seconds) from the time vacuum isolating valve 223V is completely turned off, vacuum pump unit 250 is turned off. Cooling water valve 343V is turned off and cooling water pump 243 is locked. Then fans in cooling tower unit 240 are turned off. Vacuum release valve 228 is opened to bring the pressure inside ice condenser unit 220 to the atmospheric pressure (1 atm). A one-minute time-out is given to apparatus 200 before discharge water valve 214V is opened. Front door switch 217 and rear door switch 218 are released. Vacuum freeze sugarcane juice powder can now be collected and packaged. Now, controller unit 201 can calculate the amount of water extracted from sugarcane juice by subtracting the amount of water recorded on flow meter 225M from that on flow meter 262M.

In some implementations, method 800 may include step 817, an ice defrosting (ID) operational step is performed. In this step, water vapors from sugarcane juice after sublimation is forwarded to the heater unit to use the latent heat to defrost the ice crystals formed on the fins of the heat exchange tubes.

At step 818, the settings of the ID are sensed by the sensors. Similar to step 817, the temperatures of the heater unit are sensed. In many aspects of the present invention, step 818 can be implemented by controller unit 201, database 202, vacuum freeze dried chamber 210, ice condenser unit 220, refrigerator unit 230, cooling tower unit 240, vacuum pump unit 250, and heater unit 260 of apparatus 200 described above in FIG. 2.

At step 819, if any of the settings is not correct, a controller unit or any devices that are connected to the network can alarm and adjust the settings so that the optimal defrosting results can be achieved. In many embodiments of the present invention, step 819 can be implemented by controller unit 201, database 202, and sensors such as, 215, 216, 219, 225M, 229, 252, 262M, 263, 264, etc.

At step 820, after correct the settings of the ID, the controller unit continues step 818. A time-out may be imposed on the system until any of the incorrect settings are adjusted and all the ice are cleared. In many embodiments of the present invention, step 820 can be implemented by controller unit 201.

Still referring to FIG. 8, next ice defrosting (ID) steps 818-820 are performed in apparatus 200. First, water level of heater unit 260 is measured by high water level sensor 264 and low water level sensor 265. If the water level is low, water can be refilled via feed water tube 262 and feed water valve 262V. Three-phase heating elements 261 of heater unit 260 are turned on to defrost all the ice in ice condenser unit 220. The temperature or amount of heat to defrost depend on the amount of ice formed inside ice condenser unit 220. In some situations, this temperature can reach 90° C. After the ice defrosting operation is complete, three-phase heating elements 261 are turned off. Circular heat water pump 224P is turned off. The efficiency of the convection current vacuum freeze drying process can be calculated by subtracting the amount of input water provided to heater unit 260 measured on flow meter 262M from the amount of output water measured on flow meter 225M.

Finally at step 821, the entire convection current vacuum freeze drying process 800 ends.

Implementations of process 800 disclosed above achieve the following objectives:

A precise step-by-step procedure including predetermined time durations, temperatures, pressure, flow rate, cooling rates are constantly observed and adjusted to that optimal vacuum freeze drying process can be achieved for sugarcane juice.

A fully automatic and control with minimal human involvements so that errors can be avoided, good dried sugarcane juice can be guaranteed, and efficiency can be achieved.

High cooling rate is achieved due to the use of the natural convection currents of the present invention.

Aspects of the present invention are described above with reference to flowchart illustrations and/or block diagrams of methods, apparatus (systems) and computer program sugarcane juice according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a apparatus, such that the instructions, which execute via the processor of the computer or other programmable data processing apparatus, create means for implementing the functions/acts specified in the flowchart and/or block diagram block or blocks.

Computer program code for carrying out operations for aspects of the present invention such as process 700 and 800 may be written in any combination of one or more programming languages, including an object oriented programming language such as Python, Java, Smalltalk, C++, Ladder logic, FBD, ST, IL, SFC, or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The disclosed flowchart and block diagrams illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

DESCRIPTION OF NUMERALS

100 system for preparing concentrated sugarcane juice powder
103 Mechanical connectors between units of the system 100
104 Communication channels between controller unit and the system
110 peeling and cleaning apparatus
120 sugarcane juice extracting apparatus
130 pre-freezing individual quick freezer (IQF)
200 An exemplary convection vacuum freeze drying apparatus
201 Controller unit of the exemplary CCVFD
202 Database of the exemplary CCVFD
203 Mechanical connectors between units of the exemplary CCVFD
204 Communication channels of the exemplary CCVFD
211 Freeze Dried Trays (trays)
212 Hot water pipe
212V Freeze dried chamber-heater hot water valve
212P Freeze dried chamber-heater hot water pump
213 Return water pipe
214 Discharge water pipe
214V Discharge water valve
215 First tray temperature transmitter
216 Second tray temperature transmitter
217 Front door switch
218 Rear door switch
219 Vacuum pressure transmitter
220 Convection current condensing unit (Condenser)
221 Large ice condenser and freeze dried chamber connection pipe
222*a* Liquid refrigerant pipe
222*b* Gaseous refrigerant pipe
223 Vacuum pipe
223V Vacuum isolating valve
224 Ice condenser heater hot water pipe
224V Ice condenser heater hot water valve
224P Ice condenser heater hot water pump
225 Ice condenser discharge valve
225M Ice condenser discharge flow meter
225V Ice condenser discharge valve
226 Convection current heat exchanging tubes without fins
226F Convection current heat exchanging tubes with fins
227 Expansion capillary tubes
228 Vacuum release valve
229 Ice condenser temperature transmitter
230 Refrigerator unit
231 Compressor
232 Refrigerant container
233 Liquid refrigerant heat exchanger
234 Refrigerant heat exchanger
235 Cooling water pipe
235P Cooling water pump
240 Cooling tower unit
241 Feed water pipe
241V Feed water valve
242 Hot water returning pipe
243 Cooling water pipe for vacuum pump unit
243P Cooling water pump for vacuum pump unit
243V Cooling water valve for vacuum pump unit
250 Vacuum pump unit
251 Vacuum input pipe
252 Current transformer transmitter of the vacuum pump unit
260 Water heater unit (heater)
261 Three-phase heating element
262 Feed water pipe for heater
262M Feed water flow meter for heater
262V Feed water valve for heater
263 Heater temperature transmitter
264 High water level sensor
265 Low water level sensor
300 Internal structure of convection current ice condenser unit
301 Rectangular base
310 Input reinforcement plate for top array
311 First elongate heat exchange tube with fins
312 Curved connecting tubes for top array
320 Input reinforcement plate for bottom array
322 Second elongate heat exchange tube without fins
322*a* Cold gas input from the refrigerator unit
322*b* Warm liquid output
323 Curved connecting tube for bottom array
326 Bottom array of second elongate heat exchange tubes

326F Top array of first elongate heat exchange tubes
400 sugarcane juice extracting apparatus
410 Base
411 Motor
412 Chain
500 plurality of crushing rollers
421 input terminal where sugarcane stalks are inserted
422 output terminal where residues are collected
424 Electrical compartment
426 Mechanical compartment
427 Output siphon
500A stagger formation of crushing rollers
500B mesh formation of micro ridges
510 top row
511 front crushing roller of top row
512 middle crushing roller of top row
513 bottom crushing roller on top row
520 bottom row
521 front crushing roller of bottom row
522 middle crushing roller of bottom row
523 rear crushing roller of bottom row
531 outer surface
532 outer cylindrical
533 inner cylindrical
534 main shaft
535 common axis
541 first plurality of ridges
542 second plurality of ridge
601 an exemplary rotating direction of top crushing rollers
602 opposite rotating direction of bottom crushing rollers
610 Chain
611 driving gear of crushing rollers 511-523
612 pinion gear of front crushing roller on top row
613 pinion gear of middle crushing roller on top row
614 pinion gear of rear crushing roller of top row
615 pinion gear of middle crushing roller of bottom row
620 Motor
621 driving gear of motor
622 Bottom of motor that is bolted to base

What is claimed is:

1. A concentrated sugarcane juice powder obtained by a convection current vacuum freeze drying process, said process comprising the following steps:

(a) selecting and preparing sugarcane stalks by a predetermined quality guideline;

(b) extracting sugarcane juice by inserting said sugarcane stalks into a sugarcane juice extracting apparatus having a mesh pattern of micro ridges configured to achieve a maximum sugarcane juice extraction efficiency;

(c) adding probiotics into said sugarcane juice;

(d) freezing said sugarcane juice mixed with said probiotics in frozen sugarcane juice molds using an individual quick freezer (IQF) to obtain frozen sugarcane juice blocks; and (e) vacuum freezing said frozen sugarcane juice molds using a convection current vacuum freeze drying apparatus.

2. The concentrated sugarcane juice powder of claim 1 wherein said predetermined quality guideline comprises selecting said sugarcane stalks that have a Brix level of at least 10, and performing visual inspection of said sugarcane stalks that are heavy with solid cores, and free of spoilage spots.

3. The concentrated sugarcane juice powder of claim 1 wherein said probiotics comprises *lactobasillus, streptocucus*, and *bifidobacterium.*

4. The sugarcane juice concentrate powder of claim 3 wherein an amount of 0.75 g to 1 g of *lactobasillus, streptocucus*, and *bifidobacterium* are added to every 100 g of said sugarcane juice.

5. The sugarcane juice concentrate powder of claim 4 wherein said freezing said sugarcane juice to −40° C. to −35° C. for 25 minutes to 30 minutes in said frozen sugarcane juice molds using said individual quick freezer (IQF) to form said frozen sugarcane juice blocks.

6. The sugarcane juice concentrated powder of claim 1 wherein said vacuum freezing step further comprises:

loading specific freeze drying settings for sugarcanes from a database into a controller unit;

using said controller unit to cause said convection current vacuum freeze drying apparatus to perform said vacuum freezing step in accordance with said specific freeze drying settings for sugarcanes;

measuring real-time operational parameters from said convection current vacuum freeze drying apparatus during said vacuum freezing step is performed;

comparing said specific freeze drying settings for sugarcanes with said real-time operational parameters to obtain operational differences;

if said operational differences are less than a predetermined error range, continuing said vacuum freezing step until said extracting sugarcane juice step is finished; otherwise, adjusting said real-time parameters of said convection current vacuum freeze drying apparatus until said differences in operations are less than said predetermined error range; wherein said convection current vacuum freeze drying apparatus further comprises a dryer chamber unit, a convection current condenser unit comprising a plurality of elongate heat exchange tubes each having fins arranged around an outer circumference of said plurality of elongate heat exchange tubes, a refrigerator unit, a cooling tower unit, a primary vacuum pump unit, and a heater unit.

7. A system for preparing sugarcane juice concentrated powder, comprising:

a sugarcane juice extracting apparatus having a mesh pattern of micro ridges operable to extract a maximum amount of sugarcane juice from sugarcane stalks;

a convection current vacuum freeze drying apparatus comprising:

a dryer chamber unit comprising a plurality of trays for depositing sugarcane juice blocks to be freeze dried;

a convection current condenser unit, mechanically connected to said dryer chamber unit, comprising a plurality of first elongate heat exchange tubes, each of said plurality of first elongate heat exchange tubes having fins arranged around an outer circumference of each of said plurality of first elongate heat exchange tubes, wherein said plurality of first elongate heat exchange tubes substantially fill an internal volume of said convection current condenser unit;

a refrigerator unit mechanically connected to said convection current condenser unit, operable to provide a cold refrigerant gas to said plurality of first elongate heat exchange tubes;

a cooling tower unit mechanically connected to said convection current condenser unit;

a primary vacuum pump unit, mechanically connected to said convection current condenser unit and said cooling tower unit, operable to provide a vacuum pressure to said convection current condenser unit; and a heater unit mechanically connected to provide a heat energy to both said dryer chamber unit and said convection current condenser unit;

a controller unit; and a database electrically coupled to communicate with said controller unit, wherein said controller unit is electrically coupled to control and receive sensed operational settings from said dryer chamber unit, said convection current condenser unit, said refrigerator unit, said cooling tower unit, said primary vacuum pump unit, and said heater unit, wherein said database is configured to store predetermined operational settings and wherein said controller unit is operable to compare said sensed operational settings and said predetermined operational settings.

8. The system of claim 7 wherein said sugarcane juice extracting apparatus further comprises:

an input terminal where said sugarcane stalks are inserted therethrough;

a plurality of crushing rollers arranged in a top row and a second row staggered to said top row, wherein an outer surface of each of said plurality of crushing rollers further comprises said mesh pattern of micro ridges;

a receiver basin, disposed below said plurality of crushing rollers, configured to collect said sugarcane juice; and a rejecting terminal where sugarcane residues are collected.

9. The system of claim 8 wherein said plurality of crushing rollers in said top row are arranged in tandem, wherein said plurality of crushing rollers in said bottom row are also arranged in tandem; and said top row are seated staggered to said bottom row so that a center of a front crushing roller in said top row and a center of a front crushing roller of said bottom row are offset by a distance of 3 cm to 7 cm and wherein said mesh pattern of micro ridges in said top row are engaged to said mesh pattern of micro ridges in said bottom row so that said plurality of crushing rollers create a drawing force that pulls said sugarcane stalks inward toward said rejecting terminal.

10. The system of claim 9 wherein said mesh pattern of micro ridges comprises a first plurality of ridges arranged from left to right forming an angle of 45 degrees with a central axis of each of said plurality of crushing rollers and a second plurality of ridges arranged from right to left forming an angle of 45 degrees from the central axis of each of said plurality of crushing rollers, and wherein said first plurality of ridges and said second plurality of ridges each having a height of 1.5 mm.

11. The system of claim 7 further comprising a plurality of sensors, wherein said plurality of sensors further comprise thermometers, pressure sensors, timing devices, pumps, valves, and flow meters.

12. The system of claim 11 wherein said plurality of first elongate heat exchange tubes forms a three-dimensional N×M×L array of first elongate heat exchange tubes, where N is a number of said plurality of first elongate heat exchange tubes arranged in a first direction and M is a number of said plurality of first elongate heat exchange tubes arranged in a second direction, and each of said plurality of first elongate heat exchange tubes has a length L extended in a third direction, wherein said L, M, and N are non-zero integers.

13. The system of claim 12 wherein each column of said three-dimensional N×M×L array comprises vertical zig-zag heat exchange tubes formed by said N of said plurality of first elongate heat exchange tubes.

14. The system of claim 12 wherein each of said vertical zig-zag heat exchange tubes are arranged in a horizontally staggered manner and strung together by first curved connecting tubes which alternatively connect two proximate ends and two distal ends of two adjacent said plurality of first elongate heat exchange tubes so that said vertical zig-zag elongate tubes are configured to receive a cold refrigerant gas from said refrigerator unit via said vertical zig-zag tubes located at the bottom row of said N×M×L matrix and to output a warm refrigerant liquid back to said refrigerator unit via said vertical zig-zag tubes located at the bottom row of said N×M×L matrix.

15. The system of claim 14 wherein said convection current condenser unit further comprises a three-dimensional M×N×L array of a plurality of second elongate tubes without fins, wherein said three-dimensional M×N×L array of said plurality of first elongate tubes is fixed on top of said M×N×L array of said plurality of second elongate tubes without fins.

16. The system of claim 15 wherein each column of said three-dimensional N×M×L array of a plurality of second elongate tubes without fins comprises N of said plurality of second elongate heat exchange tubes without fins arranged in a horizontally staggered manner and strung together by second curved connecting tubes which alternatively connect two consecutive proximate ends and two consecutive distal ends of two adjacent of said plurality of second elongate heat exchange tubes without fins so as to form second vertical zig-zag elongate tubes configured to receive a cold refrigerant gas from said refrigerator unit via said second vertical zig-zag elongate tubes located at the bottom row of said N×M×L array and output a warm refrigerant liquid back to said refrigerator unit via said second vertical zig-zag elongate tubes located at the top row of said N×M×L array of said three-dimensional N×M array; wherein M equals to 8 and N equals to 12 and wherein each of said plurality of second elongate heat exchange tubes has a length of 30 mm, a radius of 35 mm and a thickness of 3.4 mm.

17. The system of claim 16 wherein each of said plurality of first elongate heat exchange tubes further comprises a cylindrical tube and five rectangular fins arranged around an outer circumference of said cylindrical tube, wherein one of said five rectangular fins is located on top of said cylindrical tube and four rectangular fins are arranged on lateral sides of said cylindrical tube pointing downward so as to prevent ice and water from being collected on said cylindrical tube which is made of an aluminum alloy and has a circumference of 89.9 mm, a radius of 35 mm and a thickness of 3.4 mm and wherein said rectangular fin has a width of 30 mm and a length of 30 mm and a thickness of 4 mm.

18. A method for preparing a concentrated sugarcane juice powder comprising the following steps:

(a) selecting and preparing sugarcane stalks by a predetermined quality guideline;

(b) extracting sugarcane juice by inserting said sugarcane stalks into a sugarcane juice extracting apparatus having a mesh pattern of micro ridges;

(c) adding probiotics into said sugarcane juice;

(d) freezing said sugarcane juice in frozen sugarcane juice molds from −40° C. to −35° C. for 25 minutes to 30 minutes in said frozen sugarcane juice molds using a individual quick freezer (IQF) to form frozen sugarcane juice; and (e) vacuum freezing said frozen sugarcane juice molds using a convection current vacuum freeze drying apparatus wherein said vacuum freezing step further comprises:

(f) loading specific freeze drying settings for sugarcanes from a database into a controller unit;

(g) using said controller unit to cause said convection current vacuum freeze drying apparatus to perform said vacuum freezing step in accordance with said specific freeze drying settings for sugarcanes;

(h) measuring real-time operational parameters from said convection current vacuum freeze drying apparatus during said vacuum freezing step is performed;

(i) comparing said specific freeze drying settings for sugarcanes with said real-time operational parameters to obtain operational differences;

(j) if said operational differences are less than a predetermined error ranges, continuing said vacuum freezing step until said extracting sugarcane juice step is finished; otherwise, adjusting said real-time parameters of said convection current vacuum freeze drying apparatus until said differences in operations are less than a predetermined error ranges; wherein said convection current vacuum freeze drying apparatus further comprises a dryer chamber unit, a convection current condenser unit comprising a plurality of elongate heat exchange tubes each having fins arranged around an outer circumference of said plurality of elongate heat exchange tubes, a refrigerator unit, a cooling tower unit, a primary vacuum pump unit, and a heater unit.

19. The method of claim 18 wherein said predetermined quality guideline comprises selecting said sugarcane stalks that have a Brix level of at least 10, and performing visual inspection of said sugarcane stalks that are heavy with solid cores, and free of spoilage spots.

20. The method of claim 19 wherein an amount of 0.75 g to 1 g of said probiotics comprises *lactobasillus, streptocucus*, and *bifidobacterium* are added to every 100 g of said sugarcane juice.

* * * * *